US009091972B2

(12) United States Patent
Suzuki et al.

(10) Patent No.: US 9,091,972 B2
(45) Date of Patent: Jul. 28, 2015

(54) FIXING DEVICE HAVING A ROTATION SENSOR DRIVEN BY A HEAT ROLLER AND IMAGE FORMING APPARATUS INCORPORATING SAME

(71) Applicants: Naoto Suzuki, Kanagawa (JP); Jun Okamoto, Tokyo (JP); Satoshi Ueno, Tokyo (JP)

(72) Inventors: Naoto Suzuki, Kanagawa (JP); Jun Okamoto, Tokyo (JP); Satoshi Ueno, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/975,712

(22) Filed: Aug. 26, 2013

(65) Prior Publication Data

US 2014/0119762 A1 May 1, 2014

(30) Foreign Application Priority Data

Oct. 31, 2012 (JP) ..... 2012-240609
Jan. 31, 2013 (JP) ..... 2013-017222

(51) Int. Cl.
*G03G 15/20* (2006.01)

(52) U.S. Cl.
CPC ..... *G03G 15/2017* (2013.01); *G03G 15/2053* (2013.01); *G03G 2215/2032* (2013.01)

(58) Field of Classification Search
None
See application file for complete search history.

(56) References Cited

U.S. PATENT DOCUMENTS

2007/0183798 A1* 8/2007 Moriguchi et al. ..... 399/33
2010/0303521 A1 12/2010 Ogawa et al.
2011/0008082 A1* 1/2011 Nanno ..... 399/329
2011/0229161 A1 9/2011 Ueno et al.

FOREIGN PATENT DOCUMENTS

| | | | | |
|---|---|---|---|---|
| JP | 2-131269 | | 5/1990 | |
| JP | H11-065336 | * | 3/1999 | ..... G03G 15/20 |
| JP | 2001-203072 | | 7/2001 | |
| JP | 2002-008845 | | 1/2002 | |
| JP | 2002-040839 | | 2/2002 | |
| JP | 2004-102121 | * | 4/2004 | ..... G03G 15/20 |
| JP | 2005-070321 | | 3/2005 | |
| JP | 2005-070376 | | 3/2005 | |
| JP | 2005-077609 | | 3/2005 | |
| JP | 2005-181488 | | 7/2005 | |
| JP | 2006-011294 | | 1/2006 | |
| JP | 2006-267330 | | 10/2006 | |
| JP | 2008-139452 | | 6/2008 | |
| JP | 2009-258434 | | 11/2009 | |
| JP | 2010-122450 | | 6/2010 | |
| JP | 2010-276763 | | 12/2010 | |
| JP | 2011-180188 | | 9/2011 | |
| JP | 2011-191590 | | 9/2011 | |

* cited by examiner

*Primary Examiner* — Clayton E Laballe
*Assistant Examiner* — Peter L Cheng
(74) *Attorney, Agent, or Firm* — Oblon, McClelland, Maier & Neustadt, L.L.P.

(57) ABSTRACT

A fixing device includes a heat roller, a fuser member, an endless belt, a pressure member, a first rotation transmitter, a second rotation transmitter, a rotation sensor, a controller, a first biasing member, and a second biasing member. The heat roller is rotatable around a rotational axis thereof while subjected to induction heating. The fuser member is disposed parallel to the heat roller. The endless belt is looped for rotation around the heat roller and the fuser member. The pressure member is disposed opposite the fuser member via the endless belt. The first rotation transmitter is connected to the rotational axis of the heat roller to rotate around a rotational axis thereof upon rotation of the heat roller. The second rotation transmitter engages the first rotation transmitter to rotate around a rotational axis thereof upon rotation of the first rotation transmitter.

9 Claims, 6 Drawing Sheets

FIXING DEVICE HAVING A ROTATION SENSOR DRIVEN BY A HEAT ROLLER AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application Nos. 2012-240609 and 2013-017222, filed on Oct. 31, 2012 and Jan. 31, 2013, respectively, each of which is hereby incorporated by reference herein in its entirety.

BACKGROUND

1. Technical Field

The present invention relates to a fixing device and an image forming apparatus incorporating the same, and more particularly, to a fixing device that fixes a toner image in place with heat and pressure, and an image forming apparatus incorporating such a fixing device.

2. Background Art

In electrophotographic image formation, an image is formed by attracting toner particles to an electrostatic latent image on a photoconductive surface for subsequent transfer to a recording medium such as a sheet of paper. After transfer, the imaging process is followed by a fixing process using a fixing device, which permanently fixes the toner image in place on the recording medium to obtain a print output.

One specific type of the fixing device is a roller-based fixing device employing a pair of cylindrical fixing rollers, one being a fuser roller subjected to heating, and the other being a pressure roller disposed opposite the fuser roller. The pressure roller presses against the fuser roller to form a fixing nip therebetween, through which the recording sheet is conveyed. At the fixing nip, the fuser roller heats the incoming sheet to fuse and melt the toner particles, while the pressure roller presses the sheet against the fuser roller to cause the molten toner to set onto the sheet surface.

Another, more thermally efficient fixing device employs a flexible, endless fuser belt formed of material with a low heat capacity, subjected to heating and disposed opposite the pressure roller. Compared to the roller-based configuration, which involves a pair of fuser and pressure rollers both exhibiting a relatively high heat capacity, the belt-based fixing device can swiftly heat the fuser assembly to a desired operational temperature upon start-up.

To date, some fixing devices employ induction heaters (IH) to heat a fuser member, such as a belt or roller, through electromagnetic induction heating. Use of induction heaters, which generally exhibit higher heat transfer rates, and therefore can heat the fuser assembly more rapidly than conventional heaters such as halogen heaters, allows for fast effective heating performance in thermal fixing process.

Electromagnetic induction heating, although highly efficient in terms of heat generation, may not work properly as desired when applied to heating of a rotatable fuser member. That is, where the fuser member occasionally stops rotation while subjected to electromagnetic induction heating, an extraordinary high amount of heat is imparted to a limited portion of the fuser member facing the induction heater. Such localized, excessive heating cause variations in temperature distribution across the fuser member, which translates into improper amounts of heat exerted to a toner image from the fuser member, resulting in incomplete fixing performance.

To address this problem, several methods have been proposed to provide a fixing device with a heating control capability that controls heating of a rotatable fuser member, in particular, an endless belt, according to readings of a rotation sensor detecting rotation of the fuser member.

For example, one such method employs a rotatable fixing film formed into a cylindrical configuration. The fixing film has a plurality of detection marks disposed along a rotational, circumferential direction of the fixing film, to which an optical sensor is directed to detect movement of the fixing film in the circumferential direction based on displacement of the detection marks. Instead of an optical sensor, detection of the film movement may be implemented using a rotary encoder in combination with a detection roller disposed in contact with the fixing belt.

Another method employs an endless fuser belt entrained around multiple rollers, including a fuser roller disposed opposite a pressure roller via the belt, and a heat roller subjected to induction heating. The fuser belt has one or more perforations along a circumferential, rotational direction thereof, to which an optical sensor is directed to detect movement of the belt in the circumferential direction based on displacement of the perforations.

Still another method employs an endless fuser belt including a thermally conductive, heat-generating layer that generates heat when subjected to induction heating. The fuser belt has one or more detection portions that are relatively transparent to infrared radiation compared to the heat-generating layer along a circumferential, rotational direction thereof, to which an infrared sensor is directed to detect movement of the belt in the circumferential direction based on displacement of the detection portions.

Yet still another method employs an endless fuser belt entrained around multiple rollers, including a fuser roller disposed opposite a pressure roller via the belt, and a heat roller subjected to induction heating. A detection roller is disposed opposite the heat roller via the belt to rotate with the belt. A rotation detector is provided, including an optical rotary encoder formed of a notched disk and a photodetector directed to the notched disk to detect rotation of the detection roller indicating concurrent movement of the belt in the circumferential direction.

BRIEF SUMMARY

Exemplary aspects of the present invention are put forward in view of the above-described circumstances, and provide a novel fixing device.

In one exemplary embodiment, the fixing device includes a heat roller, a fuser member, an endless belt, a pressure member, a first rotation transmitter, a second rotation transmitter, a rotation sensor, a controller, a first biasing member, and a second biasing member. The heat roller is rotatable around a rotational axis thereof while subjected to induction heating. The fuser member is disposed parallel to the heat roller. The endless belt is looped for rotation around the heat roller and the fuser member. The pressure member is disposed opposite the fuser member via the endless belt. The first rotation transmitter is connected to the rotational axis of the heat roller to rotate around a rotational axis thereof upon rotation of the heat roller. The second rotation transmitter engages the first rotation transmitter to rotate around a rotational axis thereof upon rotation of the first rotation transmitter. The rotation sensor is disposed adjacent to the rotational axis of the second rotation transmitter to monitor rotation of the second rotation transmitter indicating concurrent rotation of the heat roller. The controller is connected to the rotation sensor to limit heating of the heat roller where the rotation sensor detects that the heat roller does not rotate. The first biasing member is connected to the first rotation transmitter to press the heat roller against the endless belt via the first rotation transmitter. The second biasing member is connected between the first and second rotation transmitters to press the second rotation transmitter against the first rotation transmitter.

Other exemplary aspects of the present invention are put forward in view of the above-described circumstances, and provide an image forming apparatus incorporating the fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
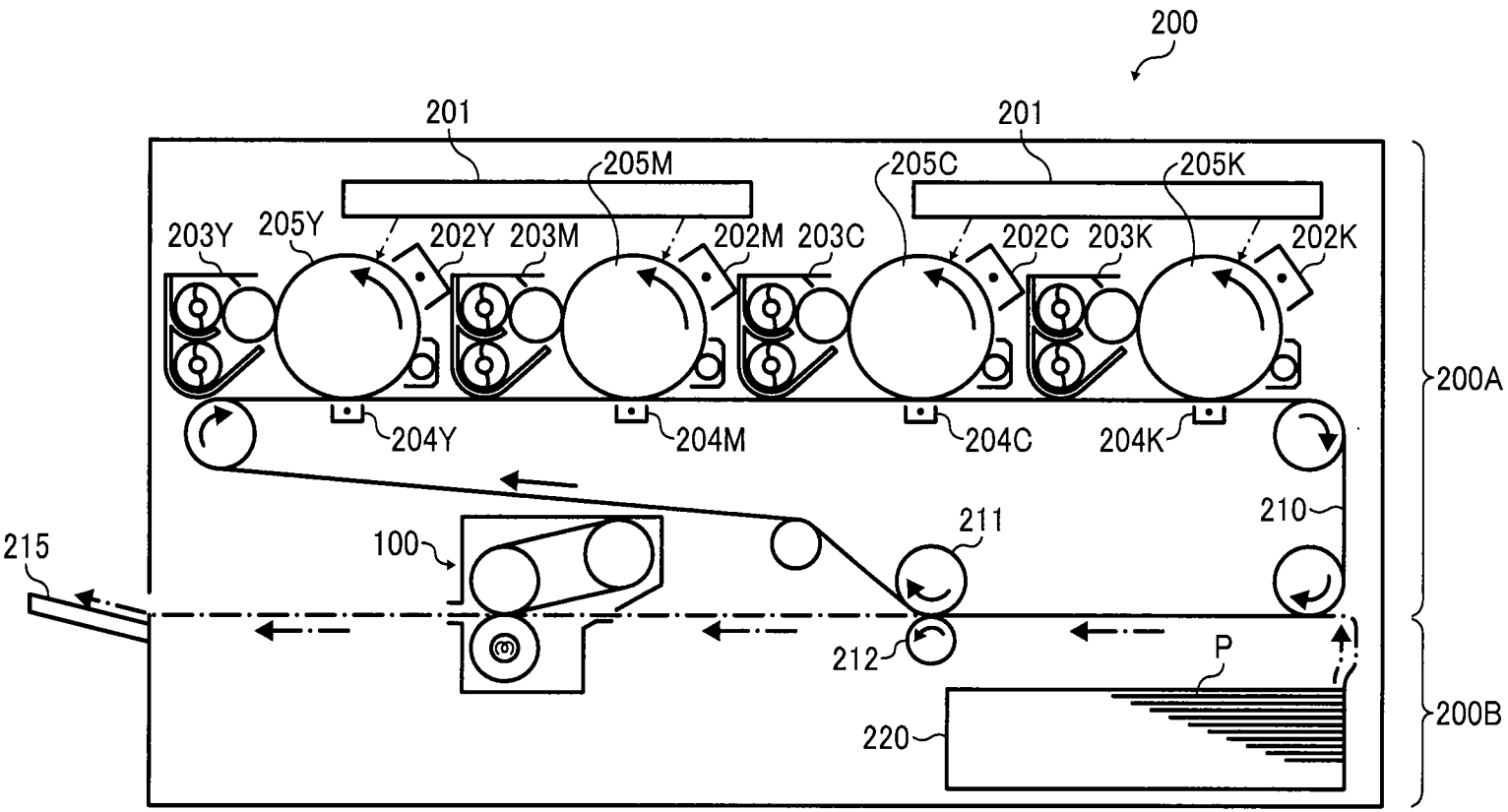
FIG. 1 is a schematic view of an image forming apparatus according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 is a schematic view of an image forming apparatus 200 according to one embodiment of this patent specification.

As shown in FIG. 1, the image forming apparatus 200 is a tandem color printer including a printing unit 200A for forming an image on a recording medium P, such as a sheet of paper, and a sheet feeding unit 200B disposed below the printing unit 200A for supplying a recording sheet P to the printing unit 200A. Additionally, an image scanner may be provided above the printing unit 200A to capture image data from an original document.

At the center of the printing unit 200A are four photoconductors 205Y, 205M, 205C, and 205K arranged in series to form toner images of particular primary colors, complementary to colors into which the original image data is decomposed, as designated by the suffixes "Y" for yellow, "M" for magenta, "C" for cyan, and "K" for black.

Each of the photoconductors 205 comprises a cylindrical drum rotatable in a direction counterclockwise in FIG. 1 and having its photoconductive, image bearing surface surrounded by multiple pieces of imaging equipment, such as a charging device 202, a development device 203, a primary transfer device 204, and a cleaning device, which work together to form a toner image on the photoconductive surface. Toner for application to each photoconductor 205 may be accommodated in the development device 203.

Located in an upper portion of the printing unit 200A is an exposure device 201 including optical equipment to emit a light beam toward the photoconductors 205 according to image data. Immediately below and along the photoconductors 205 is an intermediate transfer belt 210 looped for rotation clockwise in FIG. 1 around multiple belt-support rollers 211, including a driver roller and one or more driven rollers, to define a movable, generally horizontal surface facing the photoconductive surface. A secondary transfer roller 212 is disposed facing the belt-support roller 211 via the belt 210.

The sheet feeding unit 200B includes an input sheet tray 220 for accommodating a stack of recording sheets P. A suitable conveyance mechanism may be provided to separate each individual recording sheet P from the bottom of the sheet stack for subsequent conveyance from the input sheet tray 220 toward an output sheet tray 215 along a sheet conveyance path generally horizontally below the intermediate transfer belt 210.

A fixing device 100 is disposed downstream from the secondary transfer roller 212 along the sheet conveyance path to fix a toner image on the recording sheet P. A specific configuration of the fixing device 100 and its associated structure will be described later with reference to FIG. 2 and subsequent drawings.

During operation, the photoconductors 205Y, 205M, 205C, and 205K and their respective imaging equipment operate in a generally identical manner to form a toner image on the photoconductive surface. A general description of such imaging operation is as follows.

Specifically, each photoconductor 205 has its photoconductive surface uniformly charged by the charging device 202, followed by the exposure device 201 radiating a light beam according to image data to create an electrostatic latent image on the photoconductive surface. Then, the development device 203 renders the latent image into a visible, toner image using toner, which subsequently enters a primary transfer gap between the photoconductor 205 and the primary transfer device 204. At the primary transfer gap, an electrical bias is applied to the primary transfer device 204 to electrostatically transfer the toner image from the photoconductor 205 to the intermediate transfer belt 210.

As the intermediate transfer belt 210 rotates, toner images of four primary colors are created and superimposed one atop another to form a multicolor toner image, which subsequently enters a secondary transfer nip between the intermediate transfer belt 210 and the secondary transfer roller 212. At the secondary transfer nip, an electrical bias is applied to the secondary transfer roller 212 to electrostatically transfer the toner image from the intermediate transfer belt 210 to a recording sheet P conveyed from the input sheet tray 220 along the sheet conveyance path.

After secondary transfer, the recording sheet P bearing the toner image enters the fixing device 100, which fixes the toner image in place on the incoming sheet P with heat and pressure. After exiting the fixing device 100, the recording sheet P is forwarded to the output sheet tray 215 along the sheet conveyance path.

The image forming apparatus 200 may be configured otherwise than specifically depicted herein. For example, the order in which multiple photoconductors associated with different primary colors are arranged may be different from that depicted in FIG. 1.

Further, the image forming apparatus 200 is not limited to a tandem configuration, but includes those having a single photoconductor surrounded by multiple development devices, or those employing a revolver development device that can rotate with respect to a single photoconductor.

Furthermore, the image forming apparatus 200 may be configured as a full-color printer using three different colors, a multi-color printer using two different colors, or a monochrome printer using only a single color to reproduce an image. Application of the image forming apparatus 200 is not limited to photocopiers, but includes printers, facsimile machines, or multifunctional peripherals incorporating several of these features.

Figure 2:
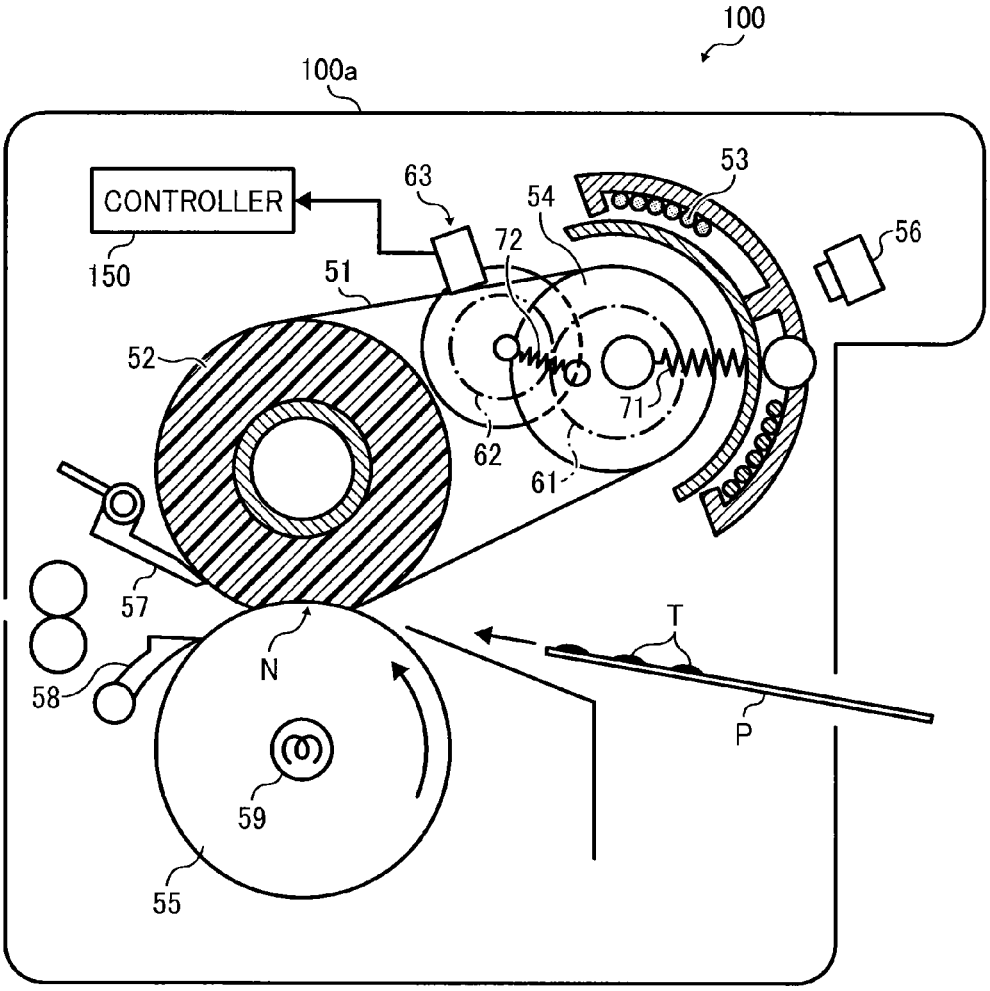
FIG. 2 is a schematic view of a fixing device according to one embodiment of this patent specification.

FIG. 2 is a schematic view of the fixing device 100 according to one embodiment of this patent specification.

As shown in FIG. 2, the fixing device 100 includes a heat roller 54 rotatable around a rotational axis thereof while subjected to induction heating; a fuser member 52 disposed parallel to the heat roller 54; an endless, fuser belt 51 looped for rotation around the heat roller 54 and the fuser member 52; and a pressure member 55 disposed opposite the fuser member 52 via the endless belt 51 to form a fixing nip N therebetween, through which a recording sheet P is conveyed to fix a toner image T thereon with heat and pressure.

The fixing device 100 includes a rotary driver operatively connected, for example, with the fuser member 52 to rotate the fuser member 52, from which torque is imparted to the pressure member 55 through the endless belt 51. It should be noted, instead of the fuser member 52, the rotary driver may be provided to the pressure member 55, in which case torque is imparted from the pressure member 55 to the fuser member 52 through the endless belt 51.

Also included in the fixing device 100 is an induction heater 53 disposed adjacent to the heat roller 54 to heat the heat roll 54 through electromagnetic induction heating. A thermometer 56, such as a thermopile, may be provided adjacent to the endless belt 51 to measure a temperature of the endless belt 51. A pair of first and second sheet separators 57 and 58 is disposed downstream from the fixing nip N, the former facing the endless belt 51 and the latter facing the pressure member 55, to facilitate separation of the recording sheet P from the endless belt 51 and the pressure member 55 upon exiting the fixing nip N. Components of the fixing device 100 described above may be enclosed in an enclosure housing 100*a* for installation in the image forming apparatus 200.

Specifically, in the present embodiment, the endless, fuser belt 51 comprises a looped belt of a single or multi-layered structure. For example, the endless belt 51 may be a bi-layered belt constructed of a substrate of suitable material, such as polyimide, covered with an outer layer of elastic material, such as silicone rubber, deposited on the substrate.

The fuser member 52 comprises a cylindrical roller constructed of a cylindrical core of metal covered with an outer layer of elastic material, such as silicone rubber, deposited on the cylindrical core. Foamed silicone rubber may be used to form the elastic outer layer to prevent excessive absorption of heat from the endless belt 51 to the fuser roller 52, which would otherwise result in an elongated time required to heat the fixing assembly during warm-up.

The heat roller 54 comprises a hollow cylindrical roller formed of metal, such as stainless steel, nickel alloy, or the like.

The pressure member 55 comprises a cylindrical roller constructed of a cylindrical core of metal, such as aluminum, iron, or the like, covered with an outer layer of elastic material, such as silicone rubber.

A releasable biasing mechanism is provided to position the pressure roller 55 between a loaded position, in which the pressure roller 55 is pressed against the endless belt 51, and an unloaded position, in which the pressure roller 55 is spaced apart from the endless belt 51. An auxiliary heater 59 may be provided to heat the pressure roller 55 where required, for example, to raise temperature swiftly or sufficiently, in which case the pressure roller 55 may have a hollow structure to accommodate the heater therein.

It should be noted that the configuration of the pressure member 55 is not limited to that specifically described herein. For example, instead of a cylindrical pressure roller, the pressure member 55 may be configured as an endless pressure belt entrained around two or more rollers, depending on specific applications.

During operation, the rotary driver rotates the fuser roller 52 in a given rotational direction clockwise in FIG. 2 to in turn rotate the endless belt 51 in the same rotational direction. The pressure roller 55, positioned through the releasable biasing mechanism into its loaded position to press against the fuser roller 52 via the endless belt 51, rotates in a rotational direction counterclockwise in FIG. 2, opposite that of the roller 52 and the endless belt 51.

At the same time, the induction heater 53 heats the heat roller 54 through induction heating, from which heat is imparted to the endless belt 51 through conduction. Such heating of the endless belt 51 may be controlled such that the temperature measured by the thermometer 56 reaches a suitable operational temperature, for example, to melt and fuse toner particles in use.

Then, a recording sheet P bearing an unfixed, powder toner image T enters the fixing device 100. As the endless belt 51 rotates with the pressure roller 55, the recording sheet P is conveyed in a conveyance direction from right to left in FIG. 2 through the fixing nip N, at which heat and pressure exerted between the endless belt 51 and the pressure roller 55 causes toner to melt and penetrate into the recording sheet P, thereby fixing the toner image T in place.

After fixing, the recording sheet P exits the fixing nip N. Where the outgoing sheet P winds around the endless belt 51, the first sheet separator 57 allows the sheet P to separate from the endless belt 51 at the exit of the fixing nip N. Where the outgoing sheet P winds around the pressure roller 55, the second sheet separator 58 allows the sheet P to separate from the endless belt 51 at the exit of the fixing nip N. The recording sheet P thus passing through the fixing nip N may be forwarded to a subsequent destination along a suitable guide member.

With continued reference to FIG. 2, the fixing device 100 is shown further including a first rotation transmitter 61 connected to the rotational axis of the heat roller 54 to rotate around a rotational axis thereof upon rotation of the heat roller 54; a second rotation transmitter 62 engaging the first rotation transmitter 61 to rotate around a rotational axis thereof upon rotation of the first rotation transmitter 61; a rotation sensor 63 disposed adjacent to the rotational axis of the second rotation transmitter 62 to monitor rotation of the second rotation transmitter 62 indicating concurrent rotation of the heat roller 54; and a controller 150 connected to the rotation sensor to limit heating of the heat roller 54 where the rotation sensor 63 detects that the heat roller 54 does not rotate.

Specifically, in the present embodiment, the first rotation transmitter 61 comprises a gear coaxially mounted to a longitudinal end of the heat roller 54 for transmitting torque or rotational force from the heat roller 54.

The second rotation transmitter 62 comprises a gear meshing with the first rotation transmission gear 61 for transmitting torque or rotational force from the first rotation transmitter 61.

More specifically, the second rotation transmitter 62 may be positioned within a space enclosed by the endless belt in its looped configuration. That is, the second rotation transmitter 62 may be interposed between the fuser roller 52, the heat roller 54, and the endless belt 51 entrained therearound.

Such positioning of the second rotation transmitter 62 reduces the risk of interference of the second rotation transmitter 62 with the adjacent edge of the endless belt 51 upon lateral displacement or deviation of the endless belt 51 from its proper path of rotation, allowing for a compact size of the endless belt assembly in the axial, longitudinal direction of the heat roller 54.

The rotation sensor 63 comprises any suitable mechanism that can detect rotational motion or position of the second rotation transmitter 62 and convert it into an electric signal for transmission to the controller 150.

More specifically, the rotation sensor 63 may be configured as a rotary encoder, such as an optical encoder or a magnetic encoder. Several examples of the rotary encoder are described below, with additional reference to FIGS. 3 through 5.

Figure 3:
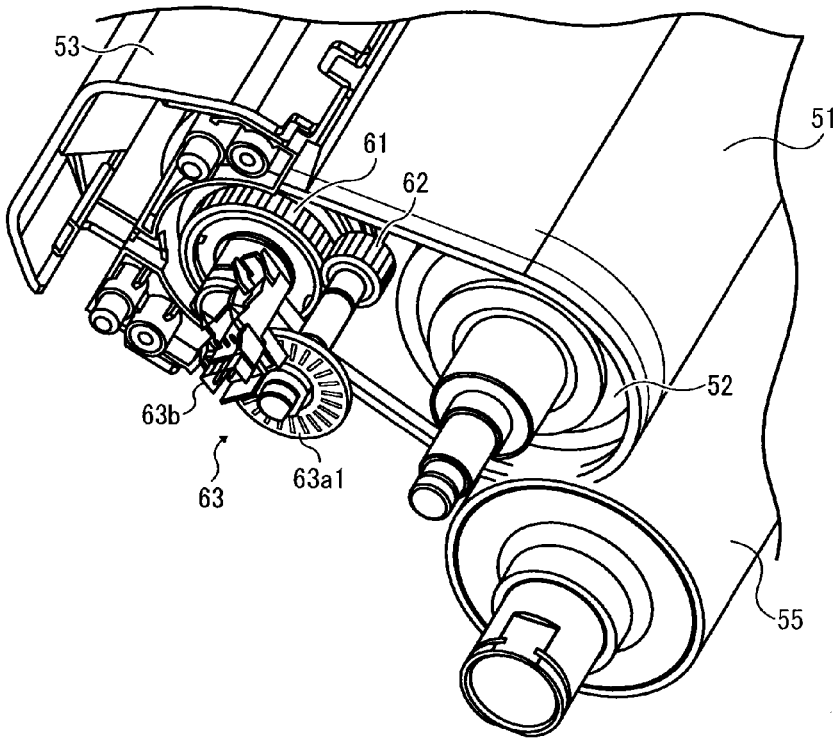
FIG. 3 is a perspective view of one example of a rotation sensor included in the fixing device of FIG. 2.

For example, the rotation sensor 63 may be configured as an optical rotary encoder formed of a rotatable slit disk 63*a*1 coaxially mounted to the rotational axis of the second rotation transmitter 62, and a photodetector 63*b* located adjacent to the slit disk 63*a*1, as shown in FIG. 3.

Figure 4:
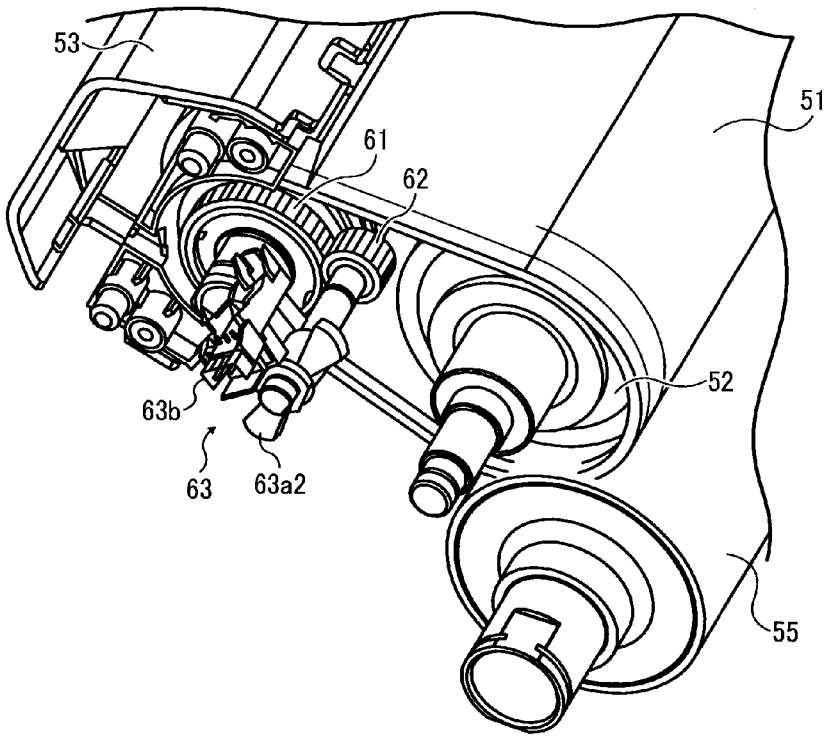
FIG. 4 is a perspective view of another example of the rotation sensor.

Alternatively, instead, the rotation sensor 63 may be configured as an optical rotary encoder formed of a rotatable vane 63*a*2 coaxially mounted to the rotational axis of the second rotation transmitter 62, and a photodetector 63*b* located adjacent to the vane 63*a*2, as shown in FIG. 4.

Use of the optical encoder allows for accurate detection of rotation of the second rotation transmitter 62, which in turn allows for accurate detection of whether the heat roller 54 rotates concurrently with the second rotation transmitter 62, leading to reliable heating control of the fixing device 100.

Figure 5:
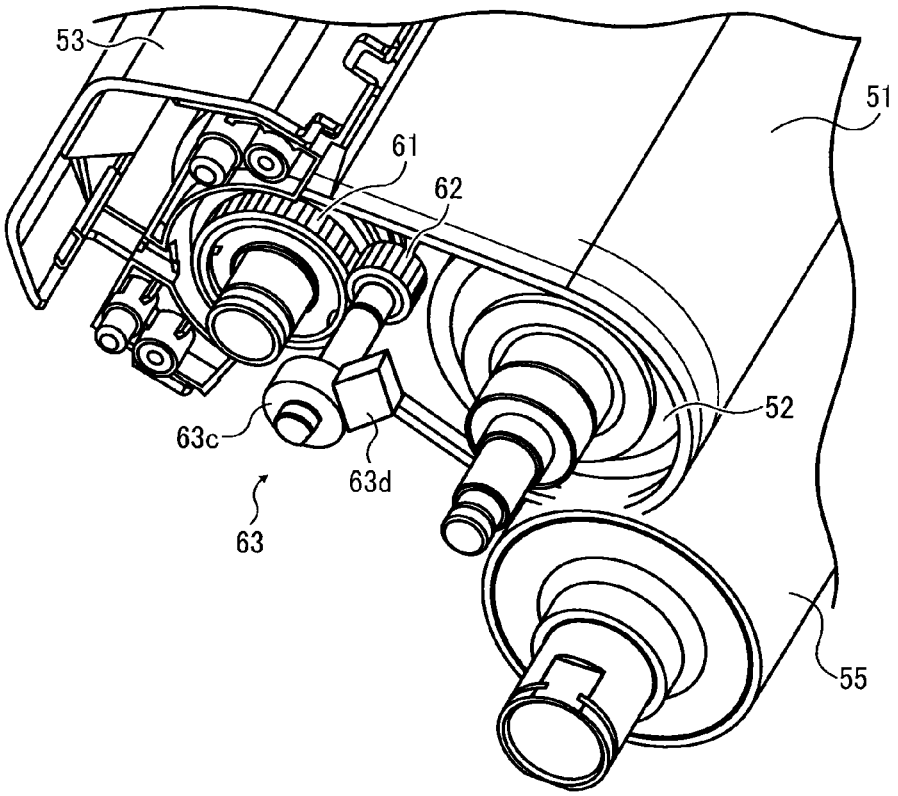
FIG. 5 is a perspective view of still another example of the rotation sensor.

Still alternatively, the rotation sensor 63 may be configured as a magnetic rotary encoder formed of a magnetized rotor 63*c* coaxially mounted to the rotational axis of the second rotation transmitter 62, and a magnetic detector 63*d* located adjacent to the rotor 63*d*, as shown in FIG. 5.

Compared to the rotary encoder, the magnetic encoder is superior in terms of compact structure, wherein the magnetic rotor is smaller than the rotatable disk or vane, and the magnetic detector is smaller than the photodetector, resulting in a relatively small space required to install the sensor assembly, leading to a compact overall size of the fixing device 100.

The controller 150 comprises electrical circuitry including a processor device, such as a microprocessor or a central processing unit (CPU), with its associated memory devices, connected between the rotation sensor 63 and the induction heater 53 to control operation of the induction heater 53 according to the detection signal from the rotation sensor 63.

Figure 6:
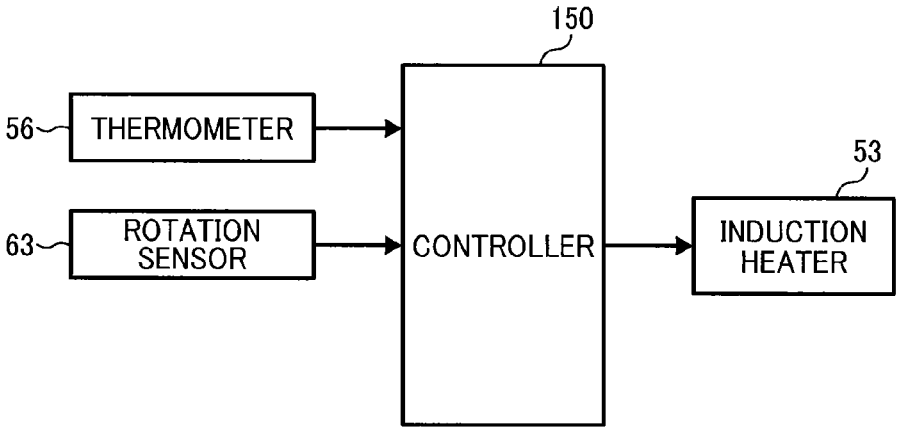
FIG. 6 is a block diagram of heating control circuitry incorporated in the fixing device of FIG. 2.

With additional reference to FIG. 6, which is a block diagram of heating control circuitry incorporated in the fixing device 100, the controller 150 is shown having a pair of input terminals connected to the thermometer 56 and the rotation sensor 63, respectively, and an output terminal connected to the induction heater 53.

During operation, the endless belt 51 and the heat roller 54 may occasionally stop rotation while the induction heater 53 continues heating the heat roller 54 through induction heating, from which heat is imparted to the endless belt 51. As the rotation sensor 63 detects that the heat roller 54 remains stationary and does not rotate around its rotational axis, the controller 150 regulates power output to the induction heater 53, such that the temperature of the endless belt 51 measured by the thermometer 56 is maintained at a suitable temperature.

Control of the induction heater 53 based on the detection signal of the rotation sensor 63 indicating presence or absence of rotation of the heat roller 54, and hence of the endless belt 51 entrained therearound, effectively prevents improper, excessive heating of the endless belt 51, which would occur where unregulated amounts of heat were supplied to the heat roller 54 in the absence of rotation of the endless belt 51 and the heat roller 54.

The inventors have recognized several problems encountered by a fixing device that controls heating of a rotatable fuser member according to readings of a rotation sensor detecting rotation of the fuser member.

For example, one known fixing device employs a rotatable fixing film formed into a cylindrical configuration. The fixing film has a plurality of detection marks disposed along a rotational, circumferential direction of the fixing film, to which an optical sensor is directed to detect movement of the fixing film in the circumferential direction based on displacement of the detection marks. Instead of an optical sensor, detection of the film movement may be implemented using a rotary encoder in combination with a detection roller disposed in contact with the fixing belt.

A drawback of this method is that the use of detection marks on the fixing film is not effectively applicable to a configuration in which the fuser member comprises an endless belt entrained around a fuser roller and a heat roller, the longitudinal end of which is loaded with a biasing mechanism to maintain tension in the belt and generally does not have a rotary mechanism.

Another technique employs an endless fuser belt entrained around multiple rollers, including a fuser roller disposed opposite a pressure roller via the belt, and a heat roller subjected to induction heating. The fuser belt has one or more perforations along a circumferential, rotational direction thereof, to which an optical sensor is directed to detect movement of the belt in the circumferential direction based on displacement of the perforations.

A drawback of this method is that providing perforations to the endless belt can reduce mechanical strength of the belt. Compared to a solid, non-perforated belt, the perforated fuser belt is susceptible to damage due to tension caused by stretching the belt around the belt-support rollers, as well as pressure exerted between the fuser roller and the pressure roller.

Still another technique employs an endless fuser belt including a thermally conductive, heat-generating layer that generates heat when subjected to induction heating. The fuser belt has one or more detection portions that are relatively transparent to infrared radiation compared to the heat-generating layer along a circumferential, rotational direction thereof, to which an infrared sensor is directed to detect movement of the belt in the circumferential direction based on displacement of the detection portions.

A drawback of this method is that providing the endless belt with detection portions adds to complication and costs of the belt-based fuser assembly. Another drawback is that the infrared sensor can be occasionally ineffective depending on thermal conditions. For example, during or immediately after sequential processing of multiple recording sheets, the fuser belt is heated to saturation or near saturation, making it difficult for the infrared sensor to distinguish the detection portions from the heat-generating layer accurately.

Yet still another technique employs an endless fuser belt entrained around multiple rollers, including a fuser roller disposed opposite a pressure roller via the belt, and a heat roller subjected to induction heating. A detection roller is disposed opposite the heat roller via the belt to rotate with the belt. A rotation detector is provided, including an optical rotary encoder formed of a notched disk and a photodetector directed to the notched disk to detect rotation of the detection roller indicating concurrent movement of the belt in the circumferential direction.

A drawback of this method is that detection of belt rotation using the rotary encoder connected indirectly to the heat roller can be inaccurate due to dimensional variations. For example, deviations of the rotational axes of the heat roller and the encoder disk can disturb engagement between the heat roller and the encoder disk, making it difficult for the rotary encoder to detect the belt rotation accurately and steadily.

These and other problems are effectively addressed by the fixing device 100 according to this patent specification. With further reference to FIG. 2, the fixing device 100 is shown further including a first biasing member 71 connected to the first rotation transmitter 61 to press the heat roller 54 against the endless belt 51 via the first rotation transmitter 61, and a second biasing member 72 connected between the first and second rotation transmitters 61 and 62 to press the second rotation transmitter 62 against the first rotation transmitter 61.

Provision of the first biasing member 71 to press the heat roller 54 against the endless belt 51 maintains appropriate tension in the endless belt 51 while creating adequate friction or traction between the endless belt 51 and the heat roller 54 to prevent undesired slippage of the endless belt 51 on the heat roller 54, which would otherwise disturb smooth, coordinated movement of the endless belt 51 with the heat roller 54. Such arrangement allows for reliable detection of rotation of the endless belt 51 based on readings of the rotation sensor 63 indicating rotation of the heat roller 54.

Further, provision of the second biasing member 72 to press the second rotation transmitter 62 against the first rotation transmitter 61 strengthens engagement between the first and second rotation transmitters 61 and 62, which can prevent loss of torque through transmission from the heat roller 54 to the second rotation transmitter 62. Such arrangement allows for more effective, reliable detection of rotation of the endless belt 51, without compromising accuracy of detection through rotation transmission between the heat roller and the rotation sensor.

Specifically, in the present embodiment, the first biasing member 71 includes one or more elastic tension members, such as coil springs, each having one end connected to the first rotation transmitter 61 and another end connected to a suitable support structure. The second biasing member 72 includes one or more elastic tension members, such as coil springs, each having one end connected to the first rotation transmitter 61 and another end connected to the second rotation transmitter 62.

More specifically, in the present embodiment, the first biasing member 71 comprises a pair of elastic tension members (of which only one is visible in FIG. 2) disposed at opposed longitudinal ends of the heat roller 54.

Using relatively simple biasing equipment such as coil springs to bias the heat roller 54 against the fuser belt 51 eliminates the need for a dedicated structure, such as a tension roller, to maintain tension in the endless belt 51, leading to a compact, uncomplicated configuration of the fixing device 100 with an effective belt rotation detection capability.

Figure 7:
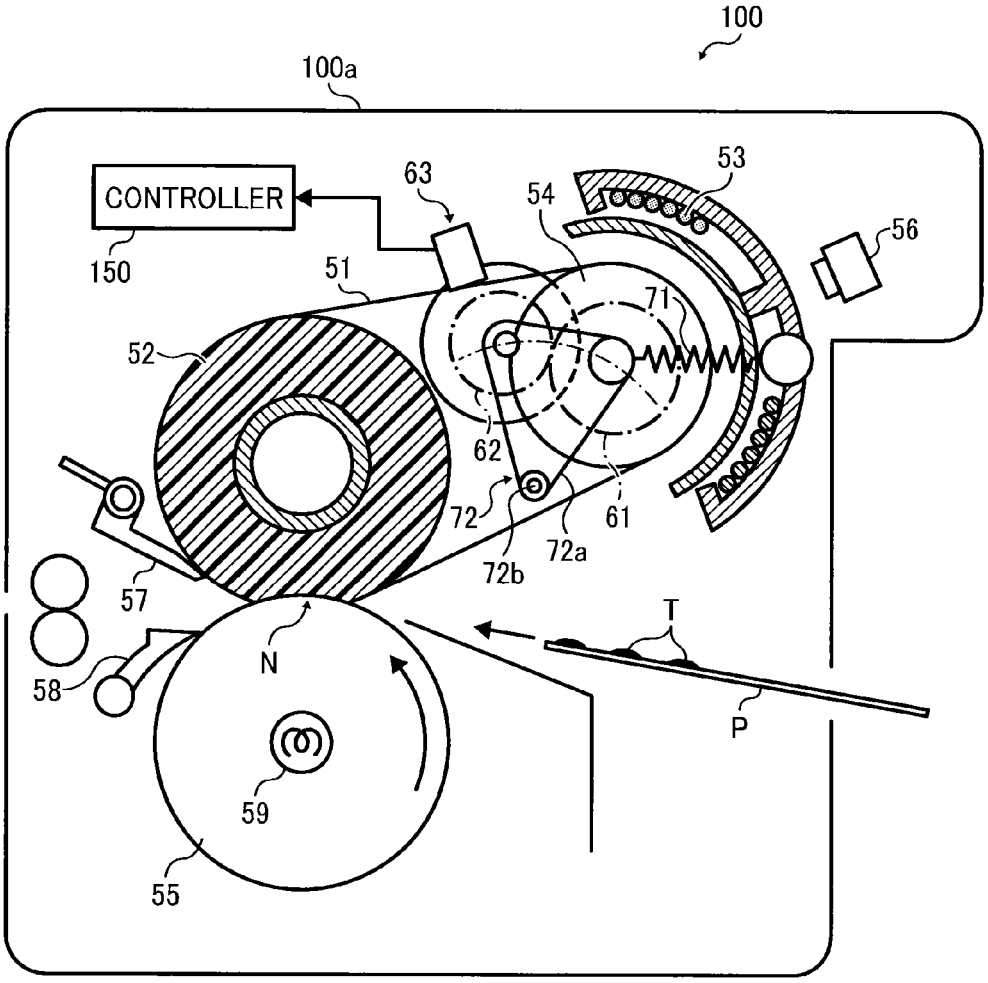
FIG. 7 is a schematic view of the fixing device according to another embodiment of this patent specification.

FIG. 7 is a schematic view of the fixing device 100 according to another embodiment of this patent specification.

As shown in FIG. 7, the overall configuration of the fixing device 100 is similar to that depicted with reference to FIG. 2, except for the configuration of the second biasing member 72.

Specifically, in the present embodiment, the second biasing member 72 includes a retainer connected to the rotational axes of the first and second rotation transmitters 61 and 62 to maintain a constant inter-axial distance between the rotational axes of the first and second rotation transmitters 61 and 62.

More specifically, in the present embodiment, the retainer 72 comprises a swivelable plate or bracket 72*a* having one end defining an opening into which a fixed pivot pin 72*b* is inserted, and another end defining a pair of openings spaced apart from each other for receiving the rotational axes of the first and second rotation transmitters 61 and 62, respectively.

During operation, the heat roller 54 may have its rotational axis displaced relative to that of the fuser roller 52, for example, due to tension in the endless belt 51 forcing the heat roller 54 toward and away from the fuser roller 52 upon thermal expansion and contraction of the fuser roller 52. In such cases, the retainer plate 72*a* can swivel around the pin 72*b* to cause the rotational axes of the first and second rotation transmitters 61 and 62 to move in a circular path (indicated by a broken line in FIG. 7) around the pin 72*b*.

Provision of the retainer plate 72*a* swivelable around the fixed pivot pin 72*b* effectively allows for maintaining a fixed inter-axial distance between the rotational axes of the first and second rotation transmitters 61 and 62 even upon displacement of the rotational axis of the heat roller 54 relative to that of the fuser roller 52, leading to more effective, reliable detection of rotation of the endless belt 51 based on readings of the rotation sensor 63 indicating rotation of the heat roller 54.

Figure 8:
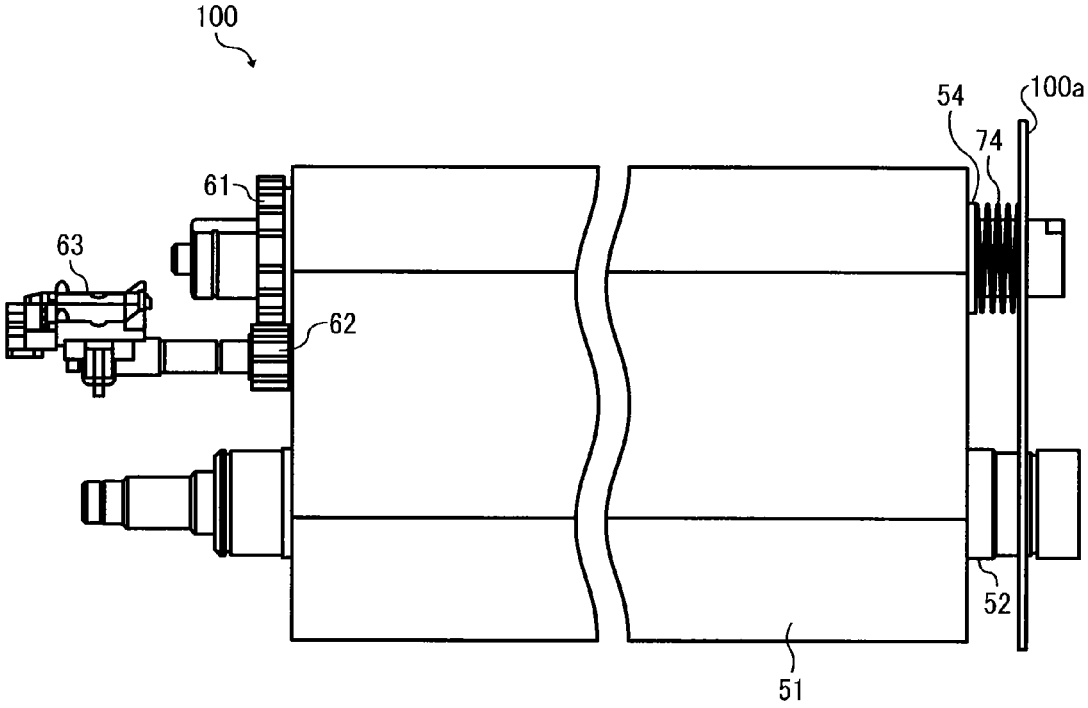
FIG. 8 is a schematic plan view of the fixing device according to still another embodiment of this patent specification.

FIG. 8 is a schematic plan view of the fixing device 100 according to still another embodiment of this patent specification.

As shown in FIG. 8, the fixing device 100 may be provided with a third biasing member 74 connected to the heat roller 54 to press the heat roller 54 against the first rotation transmitter 61 in an axial, longitudinal direction in which the rotational axis of the heat roller 54 extends.

Specifically, in the present embodiment, the third biasing member 74 comprises a compression spring disposed between one longitudinal end (opposite that provided with the first rotation transmitter 61) of the heat roller 54 and an adjacent wall of the enclosure housing 100*a* of the fixing device 100.

Provision of the third biasing member 74 to press the heat roller 54 against the first rotation transmitter 61 ensures that the first rotation transmitter 61 aligns with the second rotation transmitter 62 in the axial, longitudinal direction of the heat roller 54 even in the presence of thermal expansion and contraction of the fuser roller 52 and the heat roller 54, or lateral displacement of the endless belt 51, which would otherwise result in a reduced amount of engagement between the first and second rotation transmitters 61 and 62. Such arrangement promotes good rotation transmission between the first and second rotation transmitters 61 and 62, leading to more ready, reliable detection of rotation of the endless belt 51, without compromising accuracy of detection through rotation transmission between the heat roller and the rotation sensor.

Hence, the fixing device 100 according to several embodiments of this patent specification can detect rotation of the endless belt 51 based on readings of the rotation sensor 63 monitoring rotation of the second rotation transmitter indicating concurrent rotation 62 of the heat roller 54 accurately while allowing smooth, coordinated movement of the endless belt 51, owing to provision of the first biasing member 61 pressing the heat roller 54 against the endless belt 51 as well as the second biasing member 62 pressing the second rotation transmitter 62 against the first rotation transmitter 61.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a heat roller rotatable around a rotational axis thereof while subjected to induction heating;

a fuser member disposed parallel to the heat roller;

an endless belt looped for rotation around the heat roller and the fuser member;

a pressure member disposed opposite the fuser member via the endless belt;

a first rotation transmitter connected to the rotational axis of the heat roller to rotate around a rotational axis thereof upon rotation of the heat roller;

a second rotation transmitter engaging the first rotation transmitter to rotate around a rotational axis thereof upon rotation of the first rotation transmitter;

a rotation sensor disposed adjacent to the rotational axis of the second rotation transmitter to monitor rotation of the second rotation transmitter indicating concurrent rotation of the heat roller;

a controller connected to the rotation sensor to limit heating of the heat roller where the rotation sensor detects that the heat roller does not rotate;

a first biasing member connected to the first rotation transmitter to press the heat roller against the endless belt via the first rotation transmitter; and a second biasing member that includes an elastic body connected between the first and second rotation transmitters to press the second rotation transmitter against the first rotation transmitter.

2. The fixing device according to claim 1, wherein the first biasing member includes a pair of elastic tension members disposed at opposed longitudinal ends of the heat roller.

3. The fixing device according to claim 1, further comprising:

a third biasing member connected to the heat roller to press the heat roller against the first rotation transmitter in an axial, longitudinal direction in which the rotational axis of the heat roller extends.

4. The fixing device according to claim 1, wherein the rotation sensor comprises an optical rotary encoder.

5. The fixing device according to claim 1, wherein the rotation sensor comprises a magnetic rotary encoder.

6. The fixing device according to claim 1, wherein the second rotation transmitter is positioned within a space enclosed by the endless belt in its looped configuration.

7. An image forming apparatus incorporating the fixing device according to claim 1.

8. The fixing device according to claim 1, wherein the second biasing member is slanted relative to the first biasing member.

9. A fixing device comprising:

a heat roller rotatable around a rotational axis thereof while subjected to induction heating;

a fuser roller disposed parallel to the heat roller;

an endless belt looped for rotation around the heat roller and the fuser roller;

a pressure roller disposed opposite the fuser roller via the endless belt;

a first gear connected to the rotational axis of the heat roller to rotate around a rotational axis thereof upon rotation of the heat roller;

a second gear engaging the first gear to rotate around a rotational axis thereof upon rotation of the first gear;

a rotation sensor disposed adjacent to the rotational axis of the second gear to monitor rotation of the second gear indicating concurrent rotation of the heat roller;

a controller connected to the rotation sensor to limit heating of the heat roller where the rotation sensor detects that the heat roller does not rotate;

a first spring connected to the first gear to press the heat roller against the endless belt via the first gear; and a second spring connected between the first and second gears to press the second gear against the first gear.

* * * * *